United States Patent [19]

Lerner et al.

[11] Patent Number: 4,846,921

[45] Date of Patent: Jul. 11, 1989

[54] VERTICAL TAPE SEALING OF CARTON END WALLS

[75] Inventors: Joseph S. Lerner; David Krukas, both of Kings Park; Steven C. Novak, Brentwood, all of N.Y.

[73] Assignee: The Loveshaw Corporation, Ronkonkoma, N.Y.

[21] Appl. No.: 118,463

[22] Filed: Nov. 6, 1987

[51] Int. Cl.[4] ..... B31B 1/72

[52] U.S. Cl. ..... 156/352; 156/358; 156/362; 156/468; 156/476; 156/490; 156/518; 156/522; 53/137

[58] Field of Search ..... 156/468, 475, 476, 477.1, 156/484, 486, 489, 490, 492, 518, 522, 351, 358, 361, 362, 352; 53/137

[56] References Cited

U.S. PATENT DOCUMENTS

| | | | |
|---|---|---|---|
| 3,561,190 | 2/1971 | Derenthal | 156/486 |
| 4,039,367 | 8/1977 | Warshaw | 156/492 |
| 4,052,240 | 10/1977 | Luhman | 156/486 |
| 4,640,731 | 2/1987 | Lerner | 156/468 |

*Primary Examiner*—George F. Lesmes
*Assistant Examiner*—J. Davis
*Attorney, Agent, or Firm*—George J. Brandt, Jr.

[57] ABSTRACT

A machine is provided for applying vertical tape courses to the ends of cartons. Cartridges carrying taping members are stroked downwardly to tape the cartons. Return or upwardly directed travel of the cartridges is either delayed while a taped carton is off-feeding from the machine or the taping arms and cutter in the cartridge are retracted to allow the cartridge to be immediately returned upwardly following taping. This precludes cartridge travel interfering with carton off-feed or carton entry to the taping station.

16 Claims, 11 Drawing Sheets

VERTICAL TAPE SEALING OF CARTON END WALLS

BACKGROUND OF THE INYENTION

Most types of rectangular and similarly configured shipping cartons and particularly those which have top and/or bottom walls defined by infolded flap members are tape sealed with horizontal tape courses overlaying the seams defined by abutting edges of the infolded flap members, the horizontal tape course having end portions which extend onto carton front and rear vertical walls to provide secure anchorage for the horizontal run of the tape course. This mode of tape sealing is easily effected since most such cartons are relatively squat, i.e., they do not present unusually tall carton structures that might become upset or tip during conveyed passage through a taping machine, e.g., the type of machine described in U.S. Pat. No. 4,039,367.

There are other types of shipping cartons which cannot readily be taped with machines wherein the carton passes through the machine and tape is applied from above and/or below the carton in the tape course run referred to above. One such carton type is a telescopic shipping container wherein a cover or lid fits over a bottom or tray member. Since both the cover and tray have appreciable vertical dimension this carton may be filled with contents to a height such that the cover in place over the tray has a lower edge spaced appreciably above the tray bottom. If it was sought to tape seal this carton in an upright position with, e.g., the '367 Patent machine, the taping arms could lack length sufficient to apply a bridging run of tape from the lower region of the cover onto the tray. In similar manner such machine could not readily be used if it was proposed to simply turn the carton on its side in its travel through the machine since the contents could force the cover loose from its intended position on the tray resulting in an improperly sealed carton at best and spillage of contents from the carton during taping at worst.

Another type of carton which cannot easily be tape sealed with horizontally applied tape courses is an outsize shipping carton, i.e., one which has considerable length and Width dimension and such that the formed carton has its closure flaps at one or both of the carton ends, the ends being the panel parts of the carton of smallest area. An example of such type of carton is one in which flourescent tubes are shipped.

Sealing of these types of cartons has been made in the past by strapping them with plastic or metal banding either by hand or with a strapping machine, both procedures being highly labor intensive and marked by low production rate or unnecessarily costly. Sealing also has been accomplished by applying a vertical tape run to the carton at one or both carton ends. In the instance where an outsize carton is to be sealed, the carton is held with its large dimension horizontal and the end or flap defined walls are oriented vertically. A tape run is then applied in the fashion of a C in a course that presents terminal tape end portions adhered to the top and bottom of the carton with the intervening tape length adhered to the end wall and overlaying the inturned, infolded end wall defining flap members. In the case of a telescopic type carton, such C course will be applied from an anchoring portion on the cover, down a cover side wall bridging onto the tray and passing from the tray around to the tray bottom wall as an anchoring terminal end portion of the tape run.

Vertical taping machines which can be used to apply the course taping runs aforesaid described are known. In the operation of such machines, an operator inserts a carton against a stop in the machine which action triggers a control to cause a taping cartridge to descend and during its descent apply a C course tape seal to one carton end. The operator must then remove the carton from the machine so that the carton can ascend to a position for effecting a subsequent taping. If the thus far taped carton is to be taped at the other end, the operator must now reverse the carton and reinsert it in the machine to apply the seal at the other end. This sealing procedure is slow, requires presence of a machine operator and cannot be used in an automatically oriented packaging and shipping operation.

SUMMARY OF THE INVENTION

An object of the present invention is to provide improved forms of tape sealing machines for applying vertical tape seals to cartons which readily cannot be sealed with taping machines that apply horizontal tape runs to cartons.

Another object is to provide improved tape sealing machines for tape sealing cartons which can have varying heights such as telescopic type cartons wherein the cover can sit on a tray member at varying heights relative thereto depending on the quantity of contents packed in the carton.

A further object is to provide a tape sealing machine for taping outsize cartons, such as relatively tall cartons which could tip during sealing if such was done on conventional horizontally operating taping machines.

A still further object is to provide a vertically operating tape sealing machine which in a particularly preferred form is readily integrated into an automatic shipping line inasmuch as the operation of the machine is fully automatic not requiring the presence of a machine operator.

On one form, the machine of this invention includes an upright frame structure on which is carried a pair of vertically operating taping cartridges, the cartridges being disposed on the opposite sides of a forwardly travelling conveyor. A stop member is located along the conveyor travel path and serves to stop and hold a carton to be taped at a machine taping station, which station is situated such that when the tapIng cartridges are stroked vertically e.g., from top to bottom on the upright frame, the taping arms mounted in the cartridges will apply C course tape seals at opposite ends of the carton. Taping stroking of the cartridges can be effected by use of a detector located adjacent the carton stop member which detects the delivery of a carton by the conveyor to the taping station, the stop member being in extended position to hold the carton at the station. This detection is transmitted to a control unit which in turn allows power to stroke cylinders connected to the cartridges to stroke the cartridges downwardly and tape the carton ends. Since at the end of the taping stroke, taping arms are extending sideways from the cartridges, the cartridges cannot be stroked upwardly until the taped carton travels forwardly to a cleared position beyond the taping station. This is achieved by rendering the cartridge stroking cylinders inoperative until the carton has cleared forwardly from the taping station. To effect this, a switch member is positioned on the bottom of the upright frame so that switch when activated by arrival of the cartridges at the bottom of the machine serves to control retraction of the stop member releasing the carton to travel fowardly. The detector which initially detected carton presence at the taping station and thereby through the control unit effects down stroking of the cartridges is also used to prevent return of the cartridges to up position until a carton has cleared the taping station. The stroking cylinders can be controlled by a slide valve. When the detector detects a carton, that detection is used to electrically shift the slide valve to a position correspondind to stroking cylinder downward travel. When the releesed forwardly travelling taped carton moves beyond the detector, electrical control of the slide valve will be terminated and the slide valve will be shifted by a spring to a position for supplying power to shift the cylinders upwardly. As soon as the cylinders start to move upwardly, the switch member at the bottom of the upright frame is released and the stop member is caused to extend to thusly be in a position to stop the next carton placed in the machine at the taping position. The detector can be provided as any one of varying devices suited for that purpose, e.g., it can be a light beam projector/photo cell receiver device. The taping cartridge can be like those shown in the commonly-owned U.S. Pat. No. 4,039,367 or like the tape applicator unit 74 described in commonly-owned U.S. Pat. No. 4,640,731.

In a preferred form, the machine of the present invention will be fully automatically operating and will function to effect taping of an endless line of cartons without need for or reliance on operator intervention. Structurally, the preferred machine will be much the same as that described above but will differ from the first embodiment in regard to the control of operation and it will include means to automatically retract the cartridge taping arms and tape cutter when the cartridges are stroked upwardly following a taping operation so that unlike the first machine form, there will be no dwell or delay time associated with cartridge return travel and hence optimized taping production can be achieved.

In the fully automatic machine form, an endless line of cartons can be advanced to the machine. The foremost carton in arriving at the taping station will be stopped by the extended stop member and its arrival at the station will actuate a switch element disposed adjacent the station. This switch element activation will by its embodiment in suitable control circuitry, result in the power cylinders and hence cartridges being stroked downwardly from an upper frame position thereof to effect taping of the two ends of the carton. On arrival of the cartridges at their lower frame position, a control device will be engaged by a cartridge which will result in a number of happenings. First, the power cylinder operation controlling stop member position will be altered so that the stop member retracts releasing the taped carton to travel forwardly beyond the taping station. Concurrently, the slide valve controlling cartridge stroking cylinder operation will be shifted to power the cartridges upwardly and also the power operated cylinders carried in each cartridge and connected, respectively, with the taping arms and the tape cutter will receive power so that the taping arms and cutter are retracted into the cartridge and the cartridge thus can move upwardly past the taping station without upsetting or obstructing the arrival of the next carton to be taped at such station or the proper clearence of the taped carton from the station.

A control unit positioned downstream beyond the taping station will be employed to effect return of the stop member to extended position so that the next carton in line will be stopped at the taping station. This control unit can be a switch or photo-cell device and advantageously will be placed to perform its function of raising the stop member just before the next carton arrives at the taping station. In this manner it will serve to slightly "kick-up" the taped carton so that there is provided postive stop member presence in the machine to stop the next carton in line even though the cartons are arrayed seriatim end to end. When the upwardly travelling cartridges arrive at their upper frame location, a sWitch means will be engaged by a cartridge and this event will reault in release of power from the cylinders retracting the cartridge taping arms and the cutter and these will extend sideways from the carton in position for carrying out the next taping operation.

The invention provides that the stop member can be adjustably positioned at any one of a range of locations longitudinally along the travel course of the cartons to thereby accomodate taping cartons having varying dimensions relative to the travel course. Also the upright frames on which the cartridges are carried can be adjusted laterally of the conveyor to accomodate cartons having varying dimensions in this direction.

The invention also allows that plural cartons can be taped at the same time. For this purpose plural pairs of cartridges can be disposed on upright frames at each side of the carton travel course. In this instance, the control unit for controlling stop member extension will be positioned further downstream than in the case of single carton sealing and for that purpose it can be adjustably mounted on the machine.

The invention accordingly comprises the features of construction, combination of elements, and arrangement of parts in a carton taping machine which will be exemplified in the construction hereinafter set forth and the scope of the invention will be indicated in the claims.

BRIEF DESCRIPTION OF THE DRAWINGS

A fuller understanding of the nature and objects of the invention will be had from the following detailed description taken in conjunction with the accompanying drawings, in which.

DESCRIPTION OF THE PREFERRED EMBODIMENTS

Figure 2:
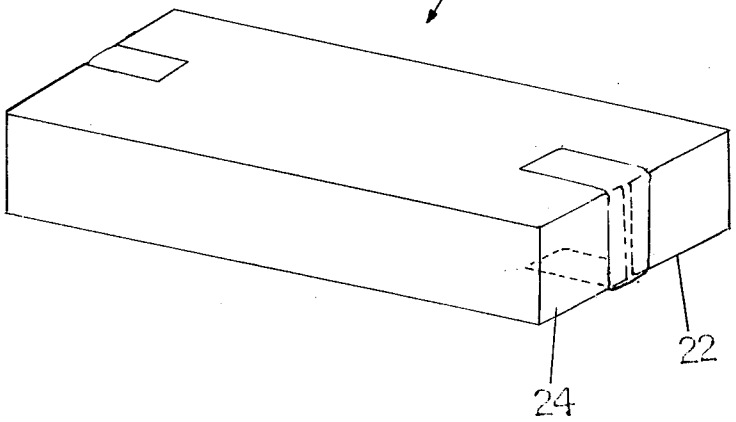
FIGS. 1 and 2 are perspective views of some of the types of rectangular shipping cartons, which can be tape sealed with a machine according to the invention.
Figure 1:
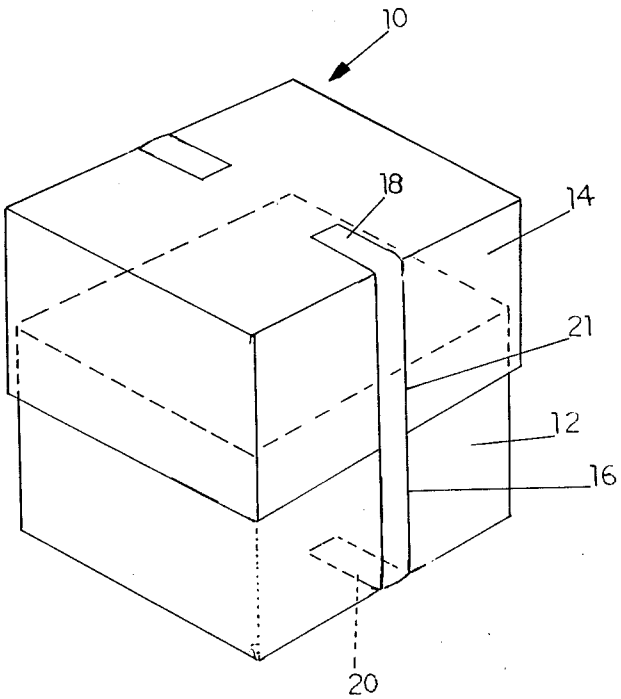

Referring to FIGS. 1 and 2, there is depicted two of the types of cartons intended to be sealed with the machines of the present invention. The FIG. 1 carton 10 is a telescopic type with a tray 12 and a cover 14. The carton 10 may be, e g., filled with computer forms in various quantities so that the cover side walls do not extend down to the bottom of the tray side walls. This carton will be sealed in the upright position shown with two C course tape seals 16, the tape seals including anchoring terminal end portions 18, 20 on the carton top and the bottom with the intervening tape run 21 extending fully down the cover side walls and onto the tray side walls. The FIG. 2 carton 26 is an "outsize" carton, i.e., it has considerable length and width expanse but low dimension in the third direction so that if the carton was stood to tape seal the infolded flaps 22, 24 on each end with horizontal tape courses, the carton easily could upset in a taping machine. Instead, the carton 26 will be taped in the orientation shown with vertical seal courses in a machine of the invention. The carton 26 also could be a type which has full end closure flaps rather than the half-flaps shown.

Figure 3:
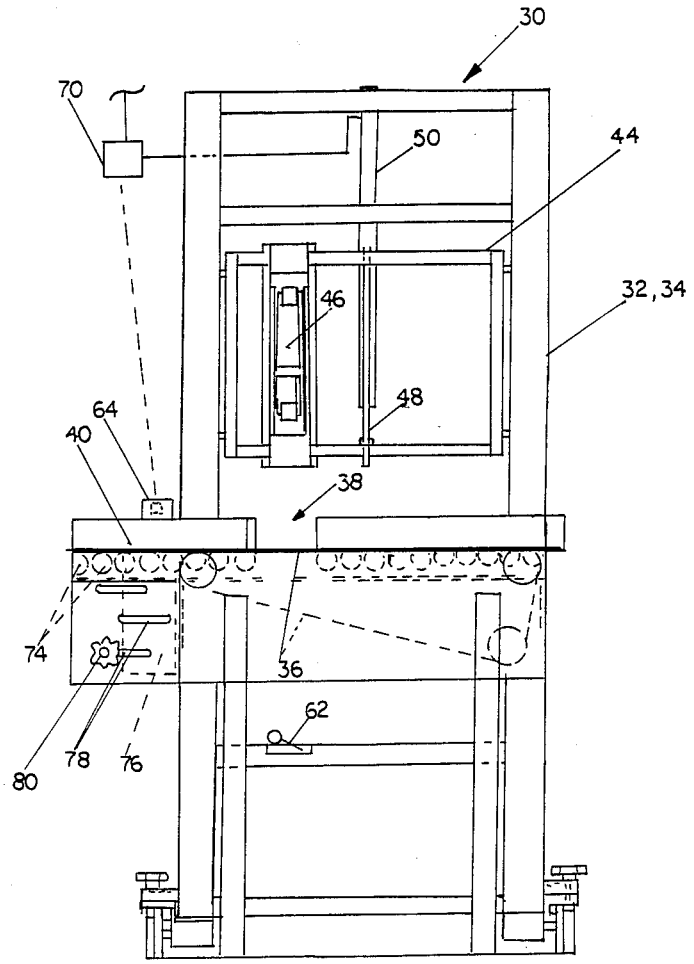
FIG. 3 is a side elevational view of a first form of the taping machine of the invention.
Figure 4:
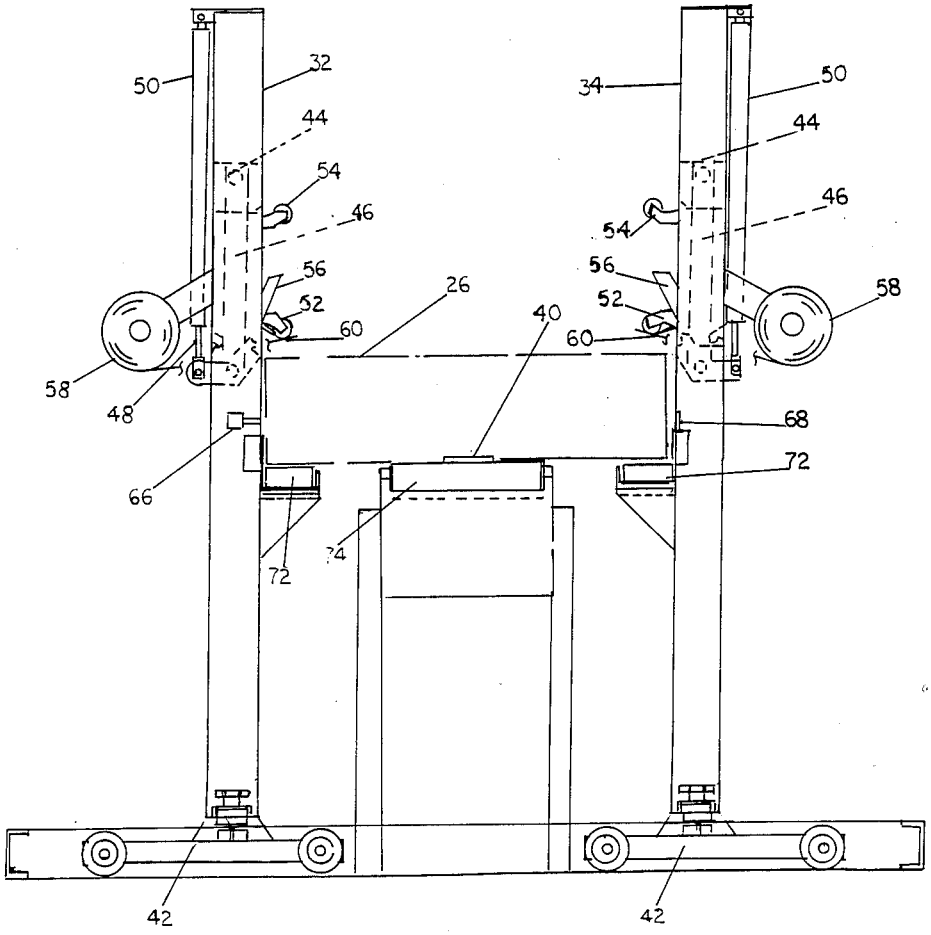
FIG. 4 is an end view of the FIG. 3 machine as viewed from the downstream end thereof.
Figure 5:
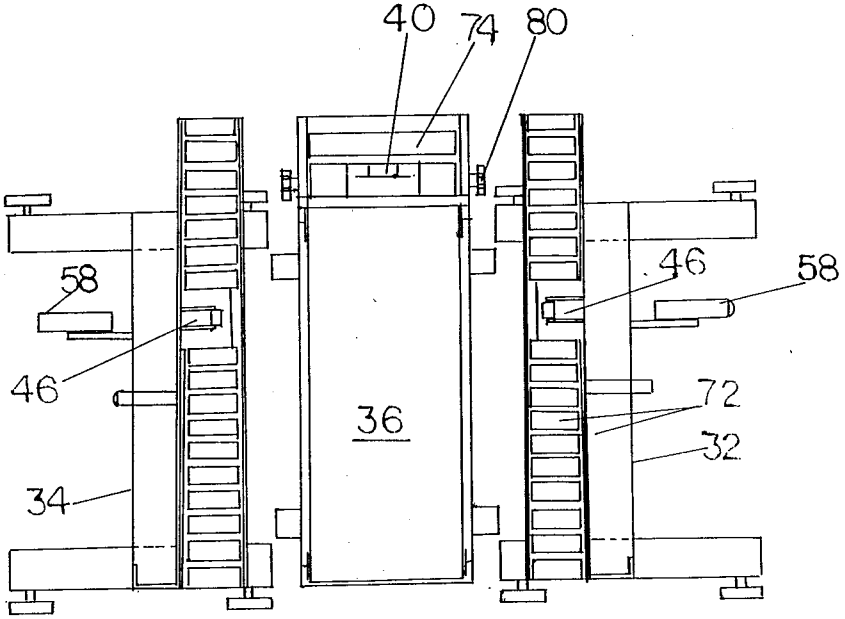
FIG. 5 is a top plan view of the machine shown in FIGS. 3 and 4.

Referring now to the first form of machine 30 shown in FIGS. 3 through 5, such machine includes supporting upright frame structure 32, 34 disposed on each side of a forwardly travelling conveyor 36, the conveyor being a belt type and employed to convey a carton 26 inserted therein by an operator forwardly to a taping station shown generally at 38 at which location the carton will be stopped and held by an extending stop member 40. The upright frames 32, 34 each are comprised of interconnected structural members as shown and are mounted on trucks 42 so that the frames can be moved toward and away from the conveyor 36 laterally to accomodate taping of cartons of differing dimensions.

Figure 7:
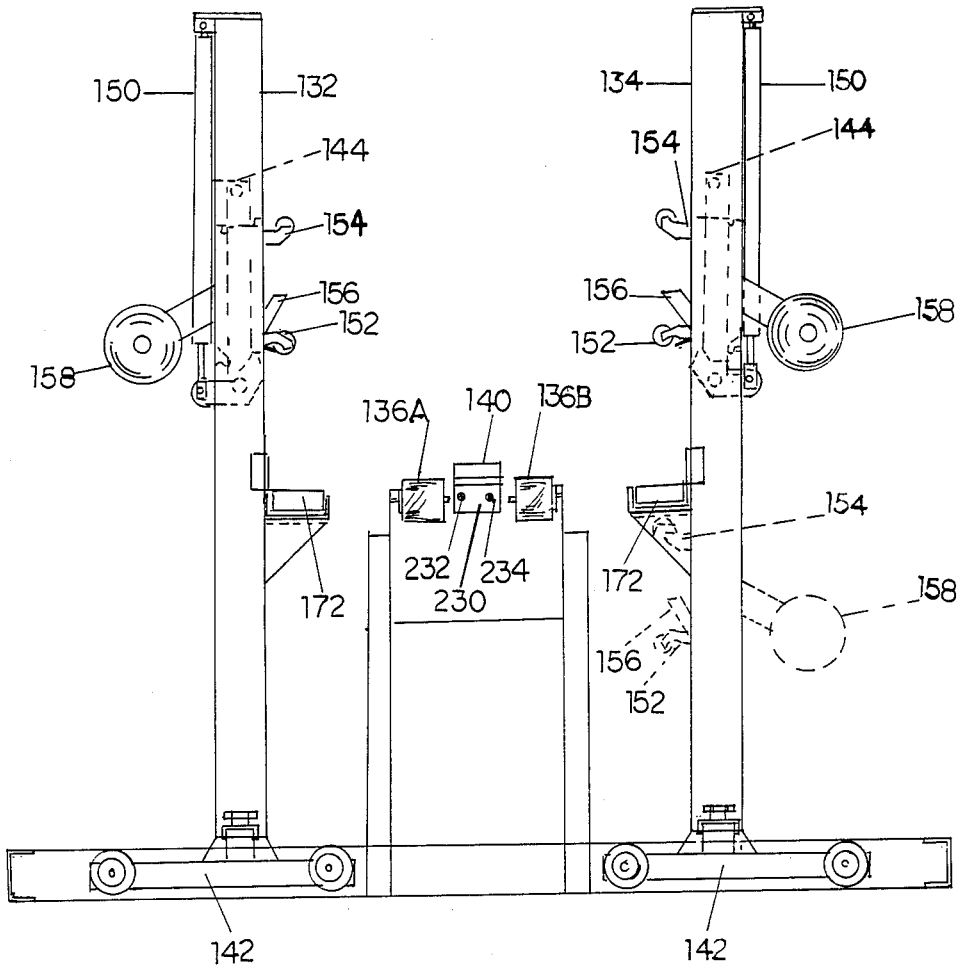
Figure 8:
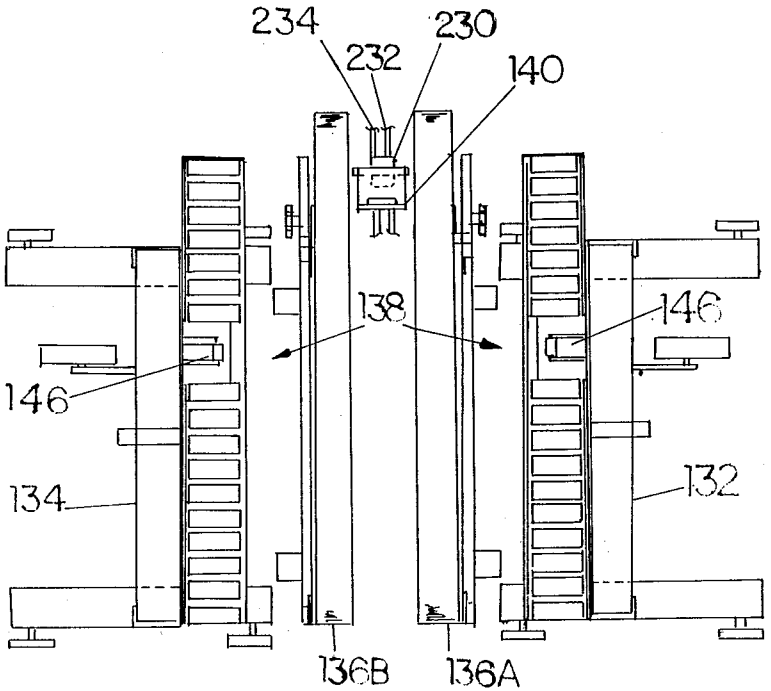

Each upright frame carries a sliding sub-frame 44 on which is mounted a taping cartridge 46, the taping cartridge being of the construction of the type described in the two earlier mentioned, commonly-owned patents, the disclosures of which are incorporated herein by reference. The sub-frames 44 are connected with the rod 48 of stroking piston units 50 so that the cartridges can be vertically stroked between an upper and lower position or location on the frame members. The upper position of the cartridge is only slightly above that shown in FIGS. 1 and 2 while the lower location thereof is shown in FIG. 7. The cartridges each carry tandemly operating taping arms 52, 54 and a cutting member 56. A tape stock 58 supplies tape 60 to a first arm 52 of each pair and presents that tape in confrontation to the top of the carton at an end thereof. When the cartridges are stroked downwardly, i.e., the cylinders or piston units 50 move sub-frames 44 downwardly, the tape held by arm 52 is applied to the carton top. As the cartridge moves down, the arms 52, 54 retract from the extended positions shown and pass onto the carton end wall applying tape thereto drawn out from the stock 58. When arm 54 clears the bottom of the carton, the arm pair will extend sideways and arm 54 will wipe the tape length onto the carton bottom completely tape sealing of an end of the carton with a vertically applied C course of tape. The applied tape length will have been severed from the tape stock by the tape cutter 56 which cutter will have been moved to retracted position by its contact with the carton during down strokes. When the cutter passes below the carton it is released and spring bias will project it in a cutting direction to cut the tape from the stock.

When the cartridges arrive at their lower location, they must be held there until the taped carton can be released and pass forwardly a certain distance of the taping station. Otherwise immediate cartridge return ascent would cause striking of the carton by the sideways extending taping arms. To effect proper carton clearance, a switch 62 is located on the upright frame. When the cartridge reaches bottom location, switch 62 is depressed. Switch 62 is in circuit with means admitting air to a cylinder unit connected to the stop member. with air supplied to that cylinder (see FIG. 7) the stop member is extended. If the air supply be terminated, a spring acting on the cylinder rod will cause it and hence the stop member 40 to retract. Switch 62 serves to effect release of air from the cylinder. Thus the carton is released and can move forwardly beyond the taping station. Disposed adjacent the stop member 40 is a detector 64, the detector by way of example including a light beam projector and recorder unit 66 and a reflector 68 (FIG. 4). This detector detects or "sees" the presence of a carton in the vicinity of the taping station. It is in turn connected with a control unit 70 which controls operation of the piston units 50. Each piston unit can be operated by positioning of a slide valve connected to an air pressure source (not shown). Detection of a carton by detector 64 can be used to apply electrical current to a coil pulling the slide valve in a direction which results in downward stroking by the piston units. In the absence of such current supply to the slide valve, a spring will shift the slide valve to a position in which air will be supplied to the piston units in a manner as to cause them to stroke upwardly.

With the cartridge at lower location and detector 64 still "seeing" a carton moving forwardly from the taping station, piston units 50 cannot be stroked upwardly. However as soon as the carton moves beyond the detector 64, it will signal the control unit 70 such occurance and the control unit will terminate electrical control of the slide valve positioning so that the slide valve is shifted and the cartridges will be stroked upwardly to their upper location. On moving up, the cartridges release switch 62 and in consequence the stop member will be extended to await arrival of another carton in the machine for taping. When a carton is thereafter deposited on the conveyor by an operator, the carton on arrival at the taping station will be seen by detector 64 and the taping operation will commence anew. An entrance gate can be provided for the machine to allow carton release from an infeed carton supply line of the next carton to be taped thereby eliminating need for an operator to perform infeed. Thus the next carton feed to the machine cannot occur until the machine is ready to tape that next carton.

As can be seen from FIG. 4, support rollers 72 can be carried on the upright frames to support cartons of considerable lateral dimension. Discharge rollers 74 can be positioned on the discharge end of the machine as seen in FIG. 3. Also the stop member 40 (including its actuating cylinder) can be mounted on an adjustable support 76, adjustable longitudinally of the carton travel direction to accomodate cartons of varying dimension. The adjustable support 76 can be supported in frame slots 78 on the machine and securement therebetween effected with hand-wheel tighteners 80.

A more preferred form of machine is shown in FIGS. 6 through 12, this machine being fully automatic in its operation. That machine embodies many of the components depicted in the FIGS. 3 through 5 construction and hence the common components are designated the same numerals with a "100" preface. That machine differs from that earlier described in that it employs two spaced conveyor belts 136 A and 136 B instead of a single belt, embodies cartridge arm and tape cutter retraction means (FIG. 9) not found in machine 30 and utilizes a different control arrangement than used in the first machine form as will be described next and with reference to taping seriatim, automatically, cartons 110 of the type shown in FIG. 1.

Figure 6:
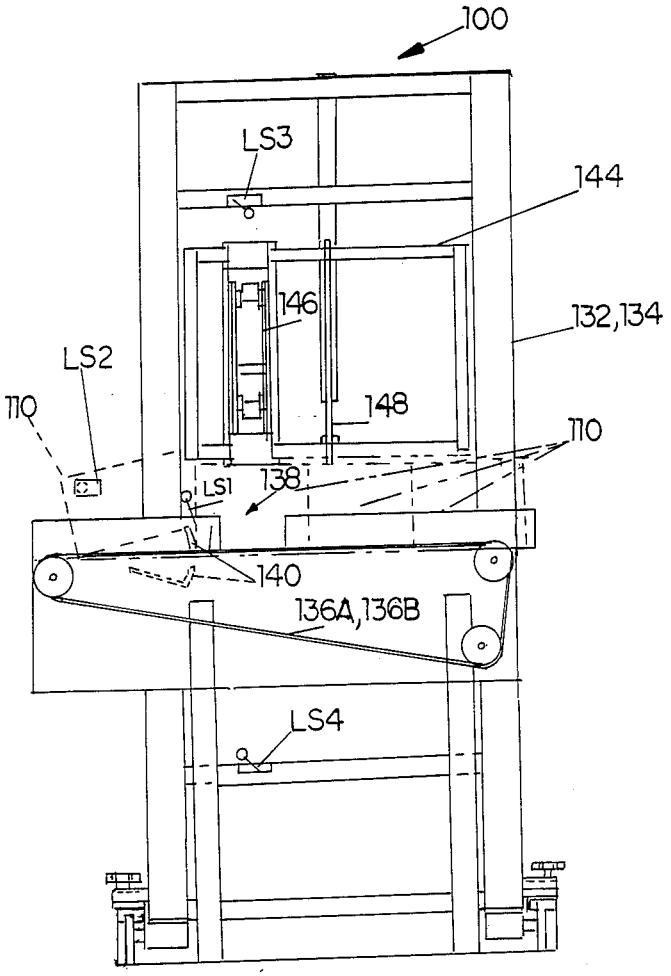
FIGS. 6 through 8 are views corresponding to FIGS. 3 through 5 but of a different form of machine which is fully automatic in the operation thereof.
Figure 9:
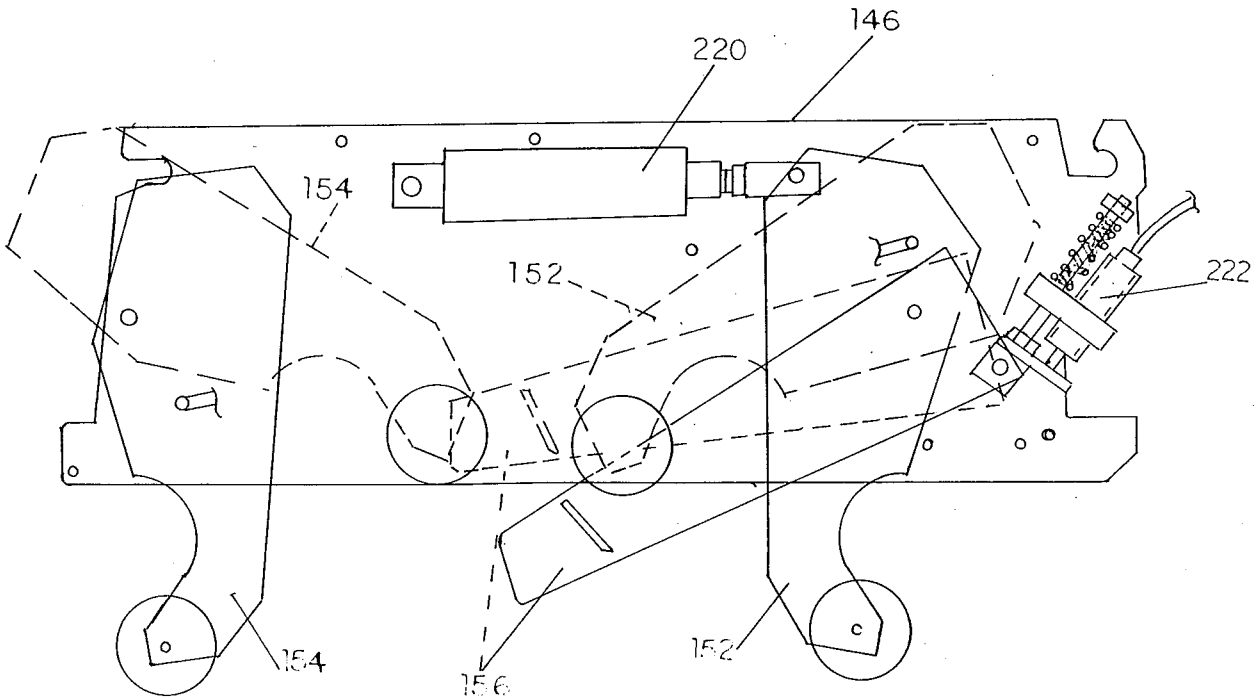
FIG. 9 is a side elevational view with a cover plate removed of one of the tape sealing cartridges used in the FIGS. 6 through 8 form of the machine and show in particular, the cylinders used for retracting the cartridge taping arms and cutting member.
Figure 10:
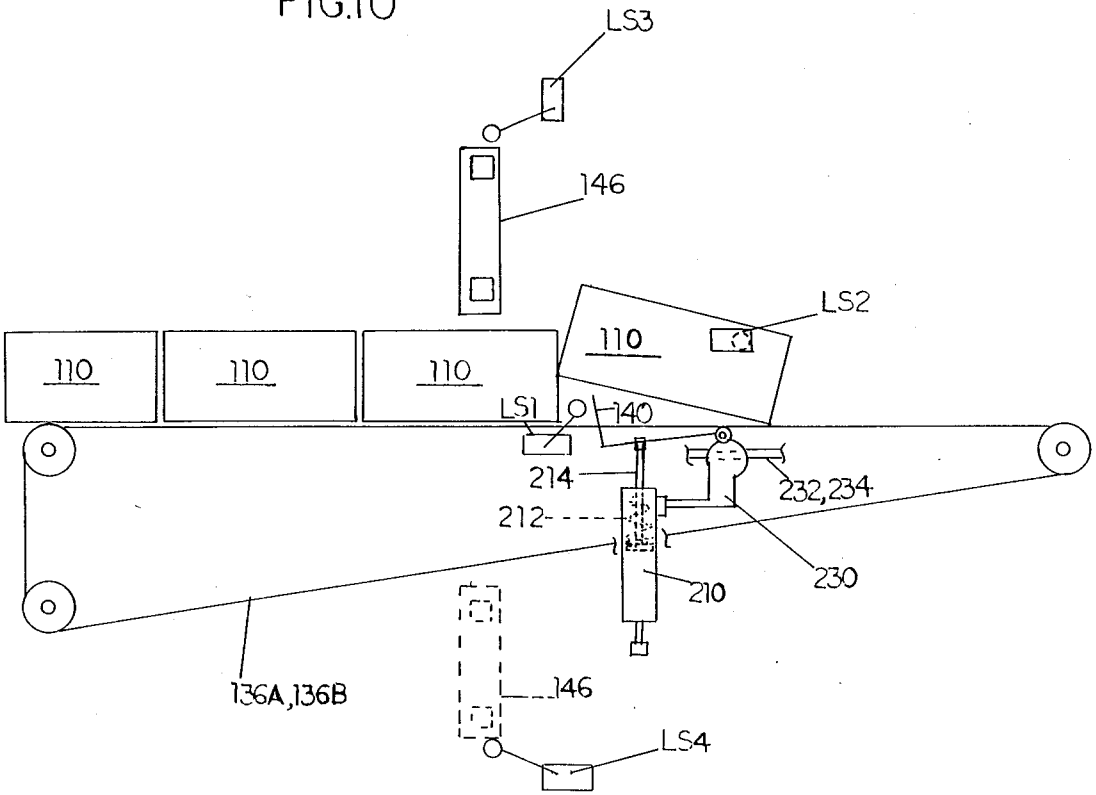
FIG. 10 is a diagrammatic depiction of the arrangement of the controlling elements and devices used in the FIGS. 6 through 8 machine and further the manner in which a taped carton is cleared forwardly from the taping station.

With reference to FIGS. 6 and 10, cartons 110 will be aligned end-on-end in entry to the machine. With the taping cartridge in the upper location and stop member 140 extended or in the up position, the foremost carton in the line will be conveyed to the taping station 138. As it arrives, it will engage switch element LS1 which engagement will result in the cartridges 146 to be stroked downwardly to tape that carton at the taping station. After taping and when a cartridge engages control device LS4 at the cartridge lower location on the upright frame, that engagement will result in certain events occuring. Air cylinder 210 for operating the stop member 140 will be de-energized of its air supply and the spring 212 therein retracts the cylinder rod 214 and the stop member, releasing the taped carton to be conveyed forwardly by conveyors 136 A, 136 B. Also the air cylinders 220, 222 connected, respectively, with the taping arms 152, 154 and the tape cutter 156 will be powered and stroked so as to move these elements to retracted position as shown in FIG. 9 in dashed lines. Also at that time the slide valve controlling operation of piston units 150 will be shifted and the cartridge will immediately be stroked upwardly without any delay or dwell thereof at the lower location. Since the taping arms and tape cutter are held retracted, no obstruction can be presented thereby to either the taped carton moving forwardly or the next inline carton arriving at the taping station. As the taped carton (best seen in FIG. 10) is moving forwardly from the taping station 138, it will be detected by control unit LS2 and that detection will function to energize cylinder unit 210 and the stop member 140 will extend to be in a position to stop the next inline carton 110. When the cartridges 146 have returned to the upper location thereof, they will engage switch means LS3 to de-energize air cylinders 220, 222 so that the cartridge arms and tape cutter extend for the next taping operation. The control functioning of elements LS1, LS2, LS3 and LS4 can be seen readily with reference to FIG. 12.

As seen in FIG. 10, cylinder unit 210 (and the stop member as a unit) can be adjusted along the machine direction to accomodate cartons of different size and for appropriate location of the stop member relative to the cartridge travel line so as to oenter the tape application properly on the carton. They can as a unit be mounted on a housing 230 disposed between conveyors 136A, 136B and slidably on a pair of shafts 232, 234. Suitable locking housing means (not shown) also will be provided.

Figure 11:
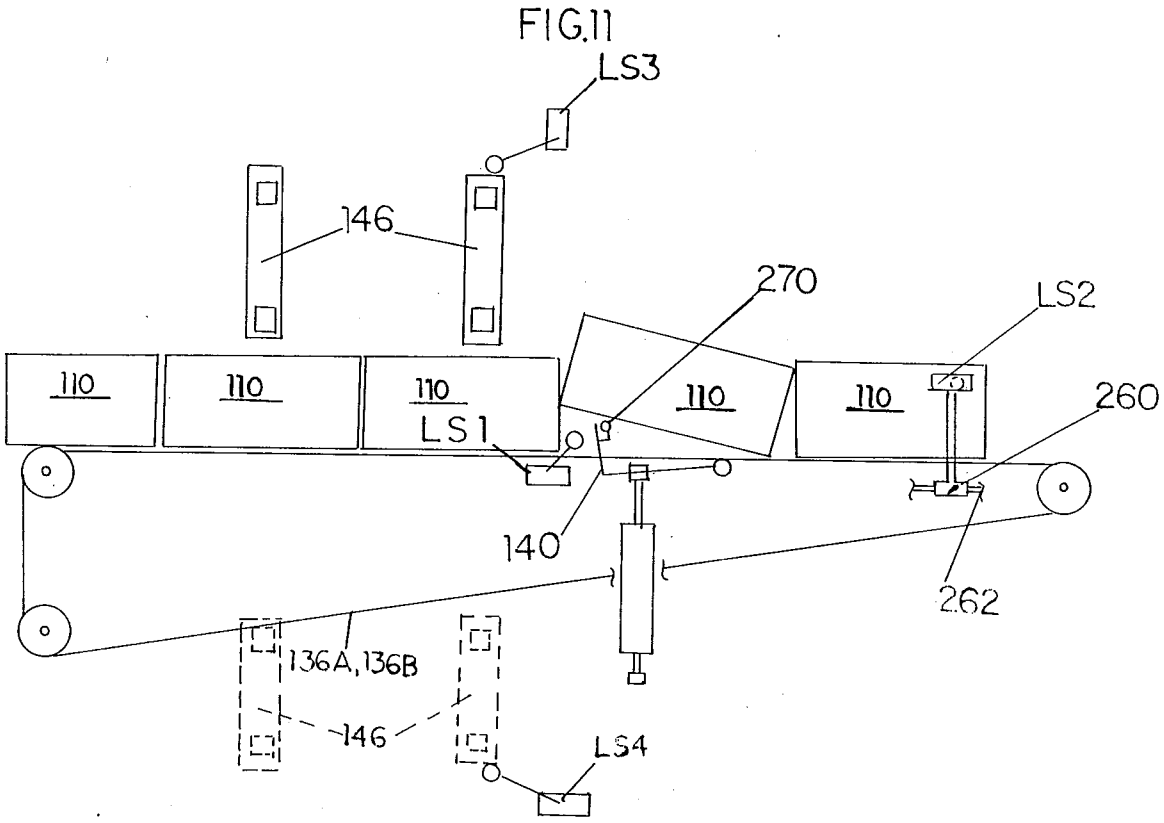
FIG. 11 is a view similar to FIG. 1 but as the machine has been modified to tape plural cartons at one time.
Figure 12:
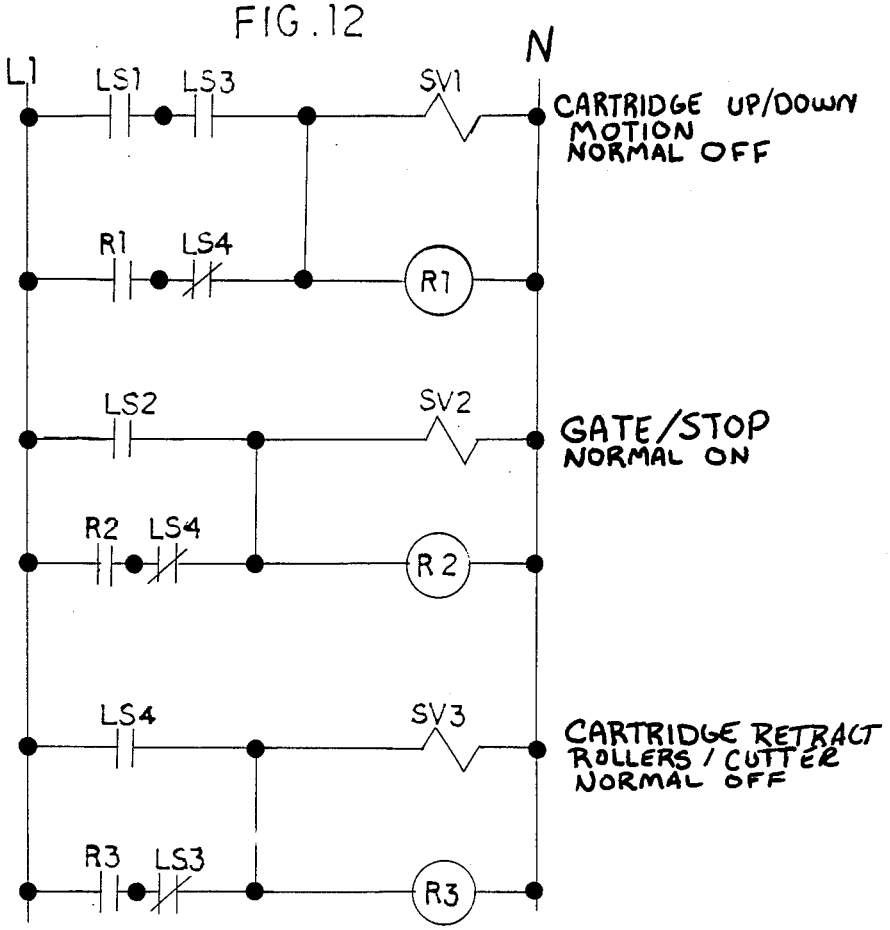
FIG. 12 is a wiring control diagram associated with control and operation of the FIGS. 6 through 8 machine Throughout the following description, like reference numerals are used to denote like parts in the drawings

FIG. 11 illustrates how more than one carton 110 can be taped at the same time. Inline pairs of taping cartridges can be provided at each side of the machine as shown in FIG. 11. These cartridges all will be stroked in tandem using the same control arrangement as described above. The difference is that detector LS2 will be located more downstream than in the FIG. 10 arrangement since it must detect the foremost carton which has been taped while the stop member must be positioned to extend under the last carton which has been taped. For this purpose, the detector LS2 can be mounted for adjustments by fixing it to a moveable housing 260 carried on shaft 262. FIG. 11 also illustrates how a roller 270 can be located as the stop member on the downstream ride thereof to facilitate roll-off of the carton from the stop member as it has been slightly elevated from the conveyor when the stop member is extended.

It will be understood that various modifications can be made in the machine construction described above without departing from the scope of the inventive concept herein disclosed.

What is claimed is:

1. A machine for applying tape seals to the end walls of rectangular shipping cartons, said tape seals including tape lengths each having terminal end portions adhered respectively to carton top and bottom walls with a tape run intervening said end portions being adhered to a carton end wall, the machine comprising an upright frame, means for conveying a carton forwardly along a horizontal travel course through the frame, an extendible retractable carton stop member disposed along the travel course and operable in a normally extended position thereof to stop the forwardly travelling carton and hold it stopped at a frame taping station, at least one taping cartridge supported on said frame for movement vertically thereon between upper and lower cartridge locations, said at least one cartridge in moving between one to the other of said locations passing adjacent an end wall of the carton when it is stopped at said taping station, each at least one taping cartridge including a pair of movably mounted tape applying arms normally biased to project sideways from the at least one cartridge so that a first arm of the pair presents an adhesive face side of pressure sensitive tape from a stock thereof in confrontation to one of said carton top and bottom walls when said carton is stopped at the taping station, cartridge stroking means operable when the carton is stopped at the taping station to stroke each at least one cartridge from the said one to the said other of said cartridge upper and lower locations during which stroked movement a first cartridge arm engages the tape presented therewith on one of said carton top and bottom walls and applies it to said one wall, the continued movement of said at least one cartridge with its first arm engaged with the carton drawing out tape from an associated stock while additionally causing such first arm to move to a retracted position in the at least one cartridge, the second arm of the pair of movably mounted arms being connected with the first arm to retract in tandem therewith, the said pair of arms of said at least one cartridge when retracted being in tape pressing contact with a carton end wall but projecting from retracted position upon pass by of the second arm beyond the other of said carton top and bottom walls, the second arm of a pair during movement from retracted to projecting positions applying tape to the said other of said carton top and bottom walls, each at least one cartridge including a movably mounted cutter normally biased to extend outwardly from the at least one cartridge in a cutting direction, such cutter being retracted from extended position by engagement thereof with the carton during catridge movement from said one to the said other of the cartridge upper and lower locations but releasing to extend under the bias thereon in a cutting direction when said cutter has passed beyond the carton whereby the cutter severs a tape length from the associated tape stock, means operable upon arrival of said at least one cartridge at said other of its upper and lower locations for controlling operations of said stop means so as to cause it to retract from its extended position whereby the taped carton is released from stopped position and resumes its forwardly conveyed travel, and means for rendering said cartridge stroking means inoperable to stroke said at least one cartridge from said other to said one of its upper and lower locations until the carton released from stopped position has been conveyed forwardly by said conveying means a clearance distance beyond said taping station.

2. A machine in accordance with claim 1 in which the stop member is connected with a power operated device, supply of power to said device extending the stop member, the stop member retracting in the absence of power supply thereto, the means for controlling operation of said stop member so as to cause it to retract comprising a switch actuated by arrival of said at least one cartridge at the said other of said upper and lower locations thereof, actuation of said switch terminating supply of power to said device.

3. A machine in accordance with claim 2 in which the cartridge stroking means is a component which is power operated in each of two opposite directions, the means for rendering the stroking means inoperable comprising a carton detector disposed adjacent said stop member, a control unit connected with said carton stroking means, said control unit being operated by the carton detector, detection of carton presence adjacent the stop member operating to orient said control unit such that power can be supplied to said cartridge stroking means to operate it only in a direction for stroking said at least one cartridge from said one to said other of its locations, absence of detection of carton presence by said detector orienting said control unit such that power can be supplied to said cartridge stroking means to operate it only in a direction for stroking said at least one cartridge from said other to said one of its locations.

4. A machine in accordance with claim 3 in which the carton detector is a light beam projector/photo-cell receiver device.

5. A machine in accordance with claim 1 comprising a pair of taping cartridges supported on said upright frame one on each side of the carton travel course and in facing relation with each other.

6. A machine for applying tape seals to the end walls of rectangular shipping cartons, said tape seals including tape lengths each having terminal end portions adhered respectively to carton top and bottom walls with a tape run intervening said end portions being adhered to a carton end wall, the machine comprising an upright frame, means for conveying a carton forwardly along a horizontal travel course through the frame, an extendible retractable carton stop member disposed along the travel course and operable in a normally extended position thereof to stop the forwardly travelling carton and hold it stopped at a frame taping station, at least one taping cartridge supported on said frame for movement vertically thereon between upper and lower cartridge locations, said at least one cartridge in moving between one to the other of said locations passing adjacent an end wall of the carton when it is stopped at said taping station, each at least one taping cartridge including a pair of movably mounted tape applying arms normally biased to project sideways from the at least one cartridge so that a first arm of the pair presents an adhesive face side of pressure sensitive tape from a stock thereof in confrontation to one of said carton top and bottom walls when said carton is stopped at the taping station, cartridge stroking means operable when the carton is stopped at at the taping station to stroke each at least one cartridge from the said one to the said other of said cartridge upper and lower locations during which stroked movement a first cartridge arm engages the tape presented therewith on one of said carton top and bottom walls and applies it to said one wall, the continued movement of said at least one cartridge with its first arm engaged with the carton drawing out tape from an associated stock while additionally causing such first arm to move to a retracted position in the at least one cartridge, the second arm of the pair of movably mounted arms being connected with the first arm to retract in tandem therewith, the said pair of arms of said at least one cartridge when retracted being in tape pressing contact with a carton end wall but projecting from retracted position upon pass by of the second arm beyond the other of said carton top and bottom walls, the second arm of a pair during movement from retracted to projecting positions applying tape to the said other of said other of said carton top and bottom walls, each at least one cartridge including a movably mounted cutter normally biased to extend outwardly from the at least one cartridge in a cutting direction, such cutter being retracted from extended position by engagement thereof with the carton during cartridge movement from said one to the said other of the cartridge upper and lower locations but releasing to extend under the bias thereon in a cutting direction when said cutter has passed beyond the carton whereby the cutter severs a tape length from the associated tape stock, means operable upon arrival of said at least one cartridge at said other of its upper and lower locations for retracting the pair of arms and cutter of each cartridge and holding said pair of arms and said cutter retracted in the at least one cartridge during return travel of said at least one cartridge from the said other to the said one of its upper and lower locations so that said arms and cutter present no obstruction during cartridge return travel to a following carton moving forwardly in the machine to be next taped at the taping station, there further being means operable upon arrival of said at least one cartridge at said other of its upper and lower locations to cause said stop member to retract, and means operable upon the travel forwardly of the taped carton a certain distance beyond the taping station for extending said stop member to stop and hold the following carton at the taping station, the means operable to cause the stop member to retract including a control device carried on the upright frame and actuatable by engagement of said at least one cartridge therewith on arrival of the at least one cartridge at said other of its upper and lower locations.

7. A machine in accordance with claim 6 in which the stop member is normally held extended by a power operated device in opposition to bias tending to retract the stop member, said control device when actuated terminating power supply to said power operated device whereby the stop member is retracted by said bias.

8. A machine in accordance with claim 7 in which the means operable upon travel forwardly of the taped carton said certain distance comprises a control unit for applying power to said power operated device.

9. A machine in accordance with claim 8 in which the means operable for retracting the pair of arms and cutter of each at least one cartridge during cartridge return travel comprises power operated components connected to said arms and said cutter, said control unit when actuated additionally controlling supply of power to said power operated components.

10. A machine in accordance with claim 9 in which separate power components are connected with one of the arms of the arm pair and with the cutter.

11. A machine in accordance with claim 10 further comprising a switch means carried on said upright frame and actuable by engagement of said at least one cartridge therewith on arrival of the at least one cartridge at its said one location at the end of the return travel thereof, said switch means functioning to terminate power supply to said power operated components.

12. A machine in accordance with claim 6 further comprising a switch element disposed adjacent the taping station, said switch element being actuable by pressure of a carton at the taping station and operable whenever a cartridge is at its said one location to initiate operation of the cartidge stroking means to stroke the at least one cartridge from its said one to the said other of its upper and lower locations.

13. A machine in accordance with claim 6 in which said carton stop member is adjustably mounted for positioning thereof at plural locations along the direction of carton travel to accommodate taping of cartons of a correspondingly plural range of dimensions.

14. A machine in accordance with claim 8 in which said control unit is adjustably positionable along the direction of carton travel for positioning of said control unit at plural locations distant the taping station to accomodate taping of cartons of different dimensions.

15. A machine in accordance with claim 6 comprising a pair of taping cartridges supported on said upright frame one on each side of the carton travel course and in facing relation with each other.

16. A machine in accordance with claim 15 comprising at least one additional pair of taping cartridges supported on said upright frame upstream of the first pair and operable in tandem with said first pair so that at least one additional carton can be taped concurrently with the taping of the first carton.

* * * * *